US005091720A

United States Patent [19]

Wood

[11] Patent Number: 5,091,720

[45] Date of Patent: Feb. 25, 1992

[54] DISPLAY SYSTEM COMPRISING A WINDOWING MECHANISM

[75] Inventor: Roger T. Wood, Romsey, England

[73] Assignee: International Business Machines Corporation, Armonk, N.Y.

[21] Appl. No.: 304,382

[22] Filed: Jan. 30, 1989

[30] Foreign Application Priority Data

Feb. 23, 1988 [GB] United Kingdom ..... 8804166

[51] Int. Cl.[5] ..... G09G 5/14

[52] U.S. Cl. ..... 340/721; 340/734; 395/131; 395/157

[58] Field of Search ..... 340/721, 734, 701, 703; 364/521, 518, 900 MS, 200 MS, 300 MS, 927.63 MS, 927.631 MS

[56] References Cited

U.S. PATENT DOCUMENTS

| | | | |
|---|---|---|---|
| 4,484,187 | 11/1984 | Brown et al. | 340/703 |
| 4,509,043 | 4/1985 | Mossaides | 340/703 |
| 4,642,790 | 2/1987 | Minshull et al. | 340/734 |
| 4,794,386 | 12/1988 | Bedrij et al. | 340/703 |
| 4,876,533 | 10/1989 | Barkins | 340/721 |

OTHER PUBLICATIONS

IBM Technical Disclosure Bulletin, "Color Display Window Control", vol. 29 No. 6 Nov. 1986 pp. 2526 and 2527.

IBM Technical Disclosure Bulletin, "Clipping and Windowing with Graphics Display", vol. 28 No. 8 Jan. 1986 pp. 3276 and 3277.

IBM Personal System/2 Display Adapter 8514/A Technical Reference Manual Apr. 2, 1987 pp. 2-87 and 2-88.

*Primary Examiner*—Jeffery A. Brier

*Attorney, Agent, or Firm*—Mark S. Walker; George E. Clark

[57] ABSTRACT

In a display system having a palette for chrominance and/or luminance information, a display buffer for information defining the pixels of a display field, including index values for indexing the palette select the chrominance and/or luminance of the pixels, a windowing mechanism is provided for associating a different range of index values with each of a plurality of windows and for responding to index values stored at individual pixel positions in the display buffer to determine the visible extent of a given window within the display field. This allows a plurality of windows to be displayed with a minimum of extra logic and without unduly constraining the choice of colors available within those windows. In the described embodiment, windows are defined in a first phase by storing index values from the range of values associated with that window at all pixel positions for that window. Then, in a second phase, the output of a range comparator for comparing index values stored in the display buffer to the range of values associated with a given window is used to control multiplexer means to cause an item of update information destined for a particular pixel position to be stored at that pixel position in the display buffer only if the comparison is positive.

19 Claims, 6 Drawing Sheets

80

A

| | 0 | 1 | 2 | 3 | 4 | 5 | 6 | 7 |
|---|---|---|---|---|---|---|---|---|
| 0 | 0 | 0 | 0 | 0 | 0 | 0 | 0 | 0 |
| 1 | 0 | 0 | 0 | 0 | 0 | 0 | 0 | 0 |
| 2 | 0 | 0 | 0 | 0 | 0 | 0 | 0 | 0 |
| 3 | 0 | 0 | 0 | 0 | 0 | 0 | 0 | 0 |
| 4 | 0 | 0 | 0 | 0 | 0 | 0 | 0 | 0 |
| 5 | 0 | 0 | 0 | 0 | 0 | 0 | 0 | 0 |
| 6 | 0 | 0 | 0 | 0 | 0 | 0 | 0 | 0 |
| 7 | 0 | 0 | 0 | 0 | 0 | 0 | 0 | 0 |

B

C

| | 0 | 1 | 2 | 3 | 4 | 5 | 6 | 7 |
|---|---|---|---|---|---|---|---|---|
| 0 | 0 | 0 | 5 | 5 | 5 | 5 | 5 | 5 |
| 1 | 0 | 0 | 5 | 5 | 5 | 5 | 5 | 5 |
| 2 | 0 | 0 | 5 | 5 | 5 | 5 | 5 | 5 |
| 3 | 0 | 0 | 5 | 5 | 5 | 5 | 5 | 5 |
| 4 | 0 | 0 | 5 | 5 | 5 | 5 | 5 | 5 |
| 5 | 0 | 0 | 0 | 0 | 0 | 0 | 0 | 0 |
| 6 | 0 | 0 | 0 | 0 | 0 | 0 | 0 | 0 |
| 7 | 0 | 0 | 0 | 0 | 0 | 0 | 0 | 0 |

D

E

| | 0 | 1 | 2 | 3 | 4 | 5 | 6 | 7 |
|---|---|---|---|---|---|---|---|---|
| 0 | 0 | 0 | 5 | 5 | 5 | 5 | 5 | 5 |
| 1 | 0 | 0 | 5 | 5 | 5 | 5 | 5 | 5 |
| 2 | 0 | 0 | 9 | 9 | 9 | 5 | 5 | 5 |
| 3 | 0 | 0 | 9 | 9 | 9 | 5 | 5 | 5 |
| 4 | 0 | 0 | 9 | 9 | 9 | 5 | 5 | 5 |
| 5 | 0 | 0 | 9 | 9 | 9 | 0 | 0 | 0 |
| 6 | 0 | 0 | 0 | 0 | 0 | 0 | 0 | 0 |
| 7 | 0 | 0 | 0 | 0 | 0 | 0 | 0 | 0 |

F

G

| | 0 | 1 | 2 | 3 | 4 | 5 | 6 | 7 |
|---|---|---|---|---|---|---|---|---|
| 0 | 0 | 0 | 5 | 5 | 5 | 5 | 5 | 5 |
| 1 | 0 | 0 | 5 | 5 | 5 | 5 | 5 | 5 |
| 2 | 0 | 0 | 9 | 9 | 9 | 5 | 5 | 5 |
| 3 | 0 | 0 | 9 | 9 | 8 | 8 | 8 | 8 |
| 4 | 0 | 0 | 9 | 9 | 8 | 8 | 8 | 8 |
| 5 | 0 | 0 | 9 | 9 | 8 | 8 | 8 | 8 |
| 6 | 0 | 0 | 0 | 0 | 8 | 8 | 8 | 8 |
| 7 | 0 | 0 | 0 | 0 | 8 | 8 | 8 | 8 |

H

A

| | | | | | | | |
|---|---|---|---|---|---|---|---|
| 11 | 11 | 11 | 8 | 10 | 11 | 11 | 11 |
| 11 | 11 | 11 | 8 | 10 | 11 | 11 | 11 |
| 11 | 11 | 11 | 8 | 10 | 11 | 11 | 11 |
| 8 | 8 | 8 | 8 | 10 | 10 | 10 | 10 |
| 8 | 8 | 8 | 8 | 10 | 10 | 10 | 10 |
| 11 | 11 | 11 | 8 | 10 | 11 | 11 | 11 |
| 11 | 11 | 11 | 8 | 10 | 11 | 11 | 11 |
| 11 | 11 | 11 | 8 | 10 | 11 | 11 | 11 |

B

| | | | | | | | |
|---|---|---|---|---|---|---|---|
| 0 | 0 | 5 | 5 | 5 | 5 | 5 | 5 |
| 0 | 0 | 5 | 5 | 5 | 5 | 5 | 5 |
| 0 | 0 | 11 | 8 | 10 | 5 | 5 | 5 |
| 0 | 0 | 8 | 8 | 18 | 18 | 18 | 18 |
| 0 | 0 | 8 | 8 | 18 | 18 | 18 | 18 |
| 0 | 0 | 11 | 8 | 18 | 18 | 18 | 18 |
| 0 | 0 | 0 | 0 | 18 | 18 | 18 | 18 |
| 0 | 0 | 0 | 0 | 18 | 18 | 18 | 18 |

C

| | | | | | | | |
|---|---|---|---|---|---|---|---|
| 10 | 11 | 11 | 11 | 11 | 11 | 11 | 11 |
| 11 | 10 | 11 | 11 | 11 | 11 | 10 | 11 |
| 11 | 11 | 10 | 11 | 11 | 10 | 11 | 11 |
| 11 | 11 | 11 | 10 | 10 | 11 | 11 | 11 |
| 11 | 11 | 11 | 10 | 10 | 11 | 11 | 11 |
| 11 | 11 | 10 | 11 | 11 | 10 | 11 | 11 |
| 11 | 10 | 11 | 11 | 11 | 11 | 10 | 11 |
| 10 | 11 | 11 | 11 | 11 | 11 | 11 | 10 |

D

| | | | | | | | |
|---|---|---|---|---|---|---|---|
| 0 | 0 | 5 | 5 | 5 | 5 | 5 | 5 |
| 0 | 0 | 5 | 5 | 5 | 5 | 5 | 5 |
| 0 | 0 | 10 | 11 | 11 | 5 | 5 | 5 |
| 0 | 0 | 11 | 10 | 18 | 18 | 18 | 18 |
| 0 | 0 | 11 | 10 | 18 | 18 | 18 | 18 |
| 0 | 0 | 10 | 11 | 18 | 18 | 18 | 18 |
| 0 | 0 | 0 | 0 | 18 | 18 | 18 | 18 |
| 0 | 0 | 0 | 0 | 18 | 18 | 18 | 18 |

DISPLAY SYSTEM COMPRISING A WINDOWING MECHANISM

FIELD OF THE INVENTION

The present invention relates to an information handling system, and more particularly to an information display system comprising a windowing mechanism.

BACKGROUND OF THE INVENTION

Windowing is a technique whereby a display field (e.g. a display screen) may be shared by a number of tasks by allowing a portion of the display to be allocated to each of the tasks. Often, the windows overlap one another which creates problems for the display system in determining which information received from the tasks is to be displayed at which position in the display field.

In a conventional type of display system, information relating to each pixel position in the display field is stored in a display buffer. There are normally a plurality of bits per pixel position, for example eight. The information for a particular pixel position in the display field identifies the color for the pixel at that position. This information can be used to drive a display device directly, or can instead be used to index a look-up table containing information for actually driving the display device. The look-up table, or palette as it is usually known, can be compared to an artist's palette, as each location, or entry, in the palette defines a particular color mix. However, the index information need not necessarily be color information but could, for example, be grey - scale information for a monochrome display. In general terms, the palette defines the chrominance and/or luminance values for the pixels of the display field.

The most widely used windowing technique is for control software to work out for each line, area of character to be displayed whether it falls totally, partly or not at all within a window in the display field and can therefore be displayed. This is a time consuming process and has severe performance disadvantages, particularly for an interactive display system. In addition, if the palette is provided as a common system resource for a number of tasks, if any of the tasks alters an entry in the palette, then this entry will also be changed for the other tasks.

Various approaches have been proposed to overcome the performance disadvantages of the above technique.

One such approach is to allocate one or more bit planes (i.e. one or more bits per pixel location) to each window and using a plane write enable mask (a mask saying which bits in each pixel are to be updated) to protect planes belonging to anything but the current window. It is possible to arrange a plurality of windows in a priority order by manipulating the palette. However, this severely limits the number of colors available. If there are eight bits per pixel (i.e. for an 8 plane machine) and four windows, then only four colors can be allocated per window. Palette control is also difficult in such an arrangement as all the windows are associated with bits in each palette entry. In view of this, when a task wishes to change one of its colors, multiple palette entries have to be modified.

Another approach to window management is to provide hardware scissoring. A window is defined in hardware which may be updated regardless of the display field contents and the data to be written. Although this technique is relatively efficient for drawing a single rectangular window, it becomes increasing inefficient as more windows are included and particularly so where windows are overlaid by others leaving non-rectangular areas visible, in which case a scissor plane is required to define the scissor boundary.

Yet a further windowing technique, for display systems with a display device in the form of a cathode ray tube (CRT), is the use of a cathode ray tube controller (CRTC) to pick up an appropriate window for display pixel by pixel from separate sources (essentially separate display buffers), one per window. This is a costly approach, however, due to the cost of additional hardware logic and additional storage for multiple screens of display data which are needed. A display system, which is generally of this type and comprises a multi-plane display buffer in which windowing is performed using an additional bit plane for selecting the source of data to be displayed, is described in an article on pages 2526 and 2527 of the IBM Technical Disclosure Bulletin, Vol. 29, No. 6 published in November, 1986.

SUMMARY OF THE INVENTION

The present invention is directed to a display system of the type which comprises a palette for chrominance and/or luminance information, a display buffer for pixel information defining the pixels of a display field, the pixel information including index values for indexing the palette (i.e. for addressing entries in the palette) to select the chrominance and/or luminance of the pixels. An object of the invention is to provide such a display system with a windowing mechanism which mitigates the problems of the prior art approaches.

Accordingly, the present invention provides a display system comprising a palette for chrominance and/or luminance information, a display buffer for pixel information defining the pixels of a display field, the pixel information including index values for indexing the palette to select the chrominance and/or luminance of the pixels, and a windowing mechanism for associating a different range of index values with each of a plurality of windows and for responding to index values stored at individual pixel positions in the display buffer to determine the visible extent of a given window within the display field.

By associating a different range of index values with each window, the windowing mechanism is able to allow a plurality of windows to be displayed with a minimum of extra logic and without unduly constraining the choice of chrominance and/or luminance (hereinafter, for conciseness, referred to as "colors") of pixels within those windows. The number of different colors available in each window will depend on the number of windows to be displayed, but each color can be selected from the full set of colors which can be specified by the palette. A consequence of associating the ranges of palette index values to respective windows is that a color within a window can be changed by modifying the content of the single palette entry indexed, or addressed by the appropriate index value.

Normally, windows are rectangular in shape, although they may be overlapped by other windows to create more complicated shapes. However, as the visible extent of a windows is determined, in the invention, from the index values stored at individual pixel locations in the display buffer, it does not matter if the shape of the visible part of a window is complicated. Moreover, if a display system in accordance with the invention includes means for initially defining windows of a non-rectangular shape such as a circle, star, etc.; these can be supported very effectively.

Preferably, the windowing mechanism comprises windowing logic for initializing a window by causing index values from the range of values associated with that window to be stored at all pixel positions for that window in the display buffer. Advantageously, the windowing logic is arranged to initialize a plurality of windows by storing the index values for each window in order of priority, starting with the lowest priority window, such that index values for a higher priority window overwrite index values previously stored in the display buffer for an overlapping part of a lower priority window. In this way, when the initialization is complete, the index values remaining in the display buffer correspond to the visible parts of the windows only.

The initialization of the display buffer is only carried out infrequently, at system initialization and when the configuration of the windows in the display field is changed. Once the display buffer has been initialized, normal updating of the display buffer is performed by simply responding to index values stored at individual pixel positions in the display buffer to determine the visible extent of a given window within the display field. This means that even if the initialization is complicated, due, for example, to a need to set up complicated window shapes and/or window overlays, this does not create a significant system overhead.

For determining the visible extent of a window, the windowing mechanism preferably comprises a range comparator for comparing index values stored in the display buffer to the range of values associated with a given window. Thus, a very simple test is performed in order to determine whether a particular pixel position falls within the visible extent of a given window, which is independent of the shape of the windows and/or the visible parts thereof remaining after the initialization phase.

Advantageously, the windowing logic causes the range comparator to determine whether an existing index value stored at a pixel position in the display buffer for which an item of update information is destined falls within the range for the given window, and the windowing mechanism additionally comprises means responsive to the output of the range comparator to cause the item of update information to be stored at that pixel position in the display buffer if the comparison is positive and otherwise to cause the existing index value to be stored again in the display buffer at that pixel position.

In a particular embodiment of a display system in accordance with the invention to be described later, the range comparator comprises an upper bound comparator for determining whether an index value stored in the display buffer is less than or equal to an maximum index value of the range and lower bound comparator for determining whether that index value is greater than or equal to a minimum value of the range, and logic gate means for combining the output of the upper and lower bound comparators for determining whether that index value is within the range defined by the maximum and minimum values of the range. In this embodiment, a maximum register and a minimum register are provided for the maximum and minimum values, respectively, of the range for the window currently being processed.

Preferably, the windowing logic is arranged to associate presentation spaces for the image data of processing tasks with respective windows. For transferring image data associated with said presentation spaces to the display buffer, the windowing logic is preferably arranged to translate color code values of image data in each of a plurality of said presentation spaces into appropriate index values within the respective ranges for the windows associated therewith. Also, the windowing logic is preferably arranged to cause the maximum and minimum values associated with a given window to be stored in the maximum and minimum registers and subsequently to pass update information for the presentation space associated with that window for updating the display buffer.

A presentation space is a virtual display buffer which is supported by the windowing logic. By providing the functions mentioned above with respect to the presentation spaces, each task can be supported so that it thinks that it has sole use of a real display buffer, although in practice the display buffer is shared between a number of tasks by means of the windows.

In an article published in January, 1986, on pages 3276 and 3277 of the IBM Technical Disclosure Bulletin, Vol. 28, No. 8, an arrangement is described whereby changes to the content of a display buffer are only allowed to those locations which contain a predefined background color. To this end, the background color is stored in a register and is compared to the colors in the display buffer. Although this arrangement allows vectors to overwrite the background color, it does not, in turn, allow the vectors to be overwritten and consequently does not provide an effective windowing function.

The IBM 8514/A graphics adapter (described in the IBM Personal System/2 Display Adapter 8514/A Technical Reference Manual) is a display system which comprises a palette for picture chrominance and/or luminance information and a buffer for pixel information defining the pixels of a display field, the pixel information including index values for indexing the palette to select the chrominance and/or luminance for the pixels. A color comparison register and color comparison logic are provided which allow the values stored in the display buffer to be compared to a given value. The comparison logic can be programmed to perform on the comparison "True", "False", "O", " ", "=", "O=", "=" and "not=" using a "set Color Comparison Register" instruction (HSCMP) described in the manual mentioned above. It is stated that the color comparison logic can be used to implement underpaint by setting the color comparison register to the color of the erased screen. This compares to the arrangement described in the TDB article mentioned in the last paragraph. There is no suggestion, however, of the color comparison register and color comparison logic being used to provide a windowing mechanism.

In the following, a particular example of a display system in accordance with the present invention is described with reference to the accompanying drawing in which:

BRIEF DESCRIPTION OF THE DRAWING

FIG. 1 is a schematic block diagram of a display system in the form of a personal computer comprising a number of different system units connected via a system bus 12. The system bus comprises a data bus 14, an address bus 16 and a control bus 18. Connected to the system bus is a microprocessor 10, random access memory 20, a keyboard adapter 28, a display adapter 32 and an I/O adapter 22. The keyboard adapter is used to connect a keyboard 30 to the system bus. The display adapter connects the system bus to a display device 34. The I/O adapter likewise provides a connection between other input/output devices 24 (e.g. DASDs) and the system bus. The personal computer may also be provided, as is shown, with a communications adapter 26 for allowing the personal computer to be connected to and to communicate with an external processor or processors such as a host processor (not shown).

FIG. 2 is a schematic block diagram of part of a display system in accordance with the present invention. In particular FIG. 2 shows part of the display adapter of FIG. 1. For reasons of clarity and ease of explanation, only those elements which are needed for an understanding of the invention are shown in the Figures.

Figure 1:
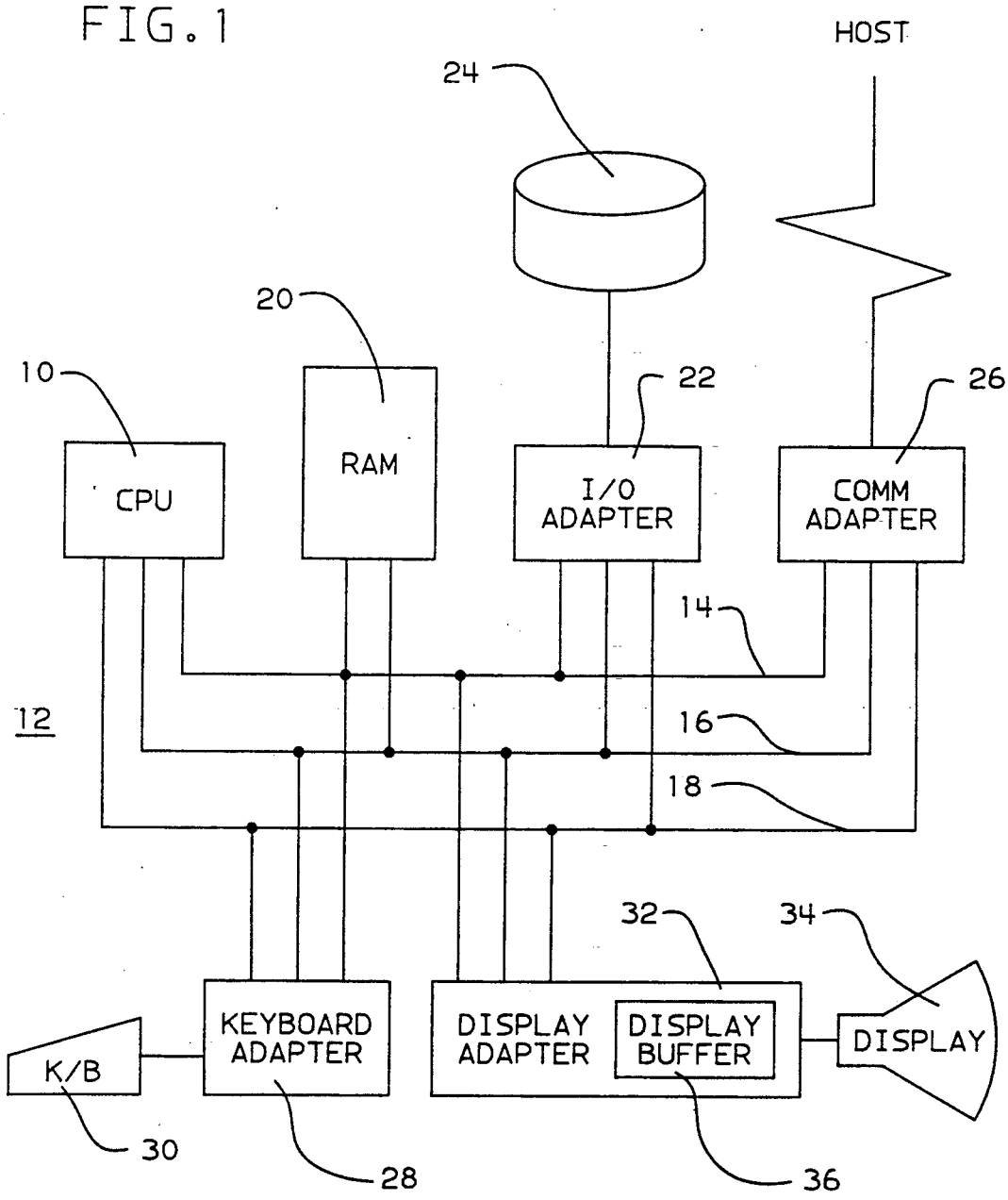
FIG. 1 is an overview of a computer in which the invention can be incorporated.

The display adapter shown comprises a display buffer 36 constituted by a dual port dynamic video RAM and having, in this embodiment, eight bit planes 361–368. Each bit plane comprises a single bit for each of the pixel positions in the display field of the display device. By combining one bit from a particular location in each of the eight bit planes it is therefore possible to provide a total of 256 (i.e. 2 to the power 8) different values for specifying the color and possibly other attributes of the corresponding pixel in the display field. The value formed from the combination of the bits for a given pixel does not define the color of the pixel directly, but instead forms an index address to a palette, or color look-up table, 38. In this embodiment, each addressed location in the palette 38 comprises eighteen bits of information specifying a particular color for display on the display screen and the palette 38 has 256 entries (i.e. one for each of the possible values which can be specified by pixel position in the display buffer).

If not all the image planes in the display buffer were to be used for specifying the color of a pixel, but were instead to be used to specify some other attribute, for example a "blink" function, then either the number of palette entries could be reduced or extra bit planes could be provided.

As shown, the display buffer has one random access data input (parallel) port RI and two data output ports, a serial port, S, and a random access output (parallel) port, RO. In practice, the random access input and output ports RI and RO will normally be in the form of a single bidirectional random access port R. They are merely shown separately in the drawing for convenience.

The serial port, S, is connected via a serializer 42 to the address input A of the palette 38. The data output DO of the palette 38 is connected to the data input of a digital to analog converter 40 which produces analog signals for controlling beam generation in a cathode ray tube (CRT) display device 34. The CRT display device shown is merely illustrative of possible display devices which may be used. In practice, any suitable display device may be used. Moreover, if the display device can be controlled digitally, then the digital to analog converter will not be required.

The random access port, R, is connected via a feedback connection 44 to a range comparator 46 for determining whether the data on the connection 44 lies within a specified range of values. The address of the data to be output through the random access port can be selected by address signals at address inputs among the control inputs, C, of the display buffer 36.

Figure 2:
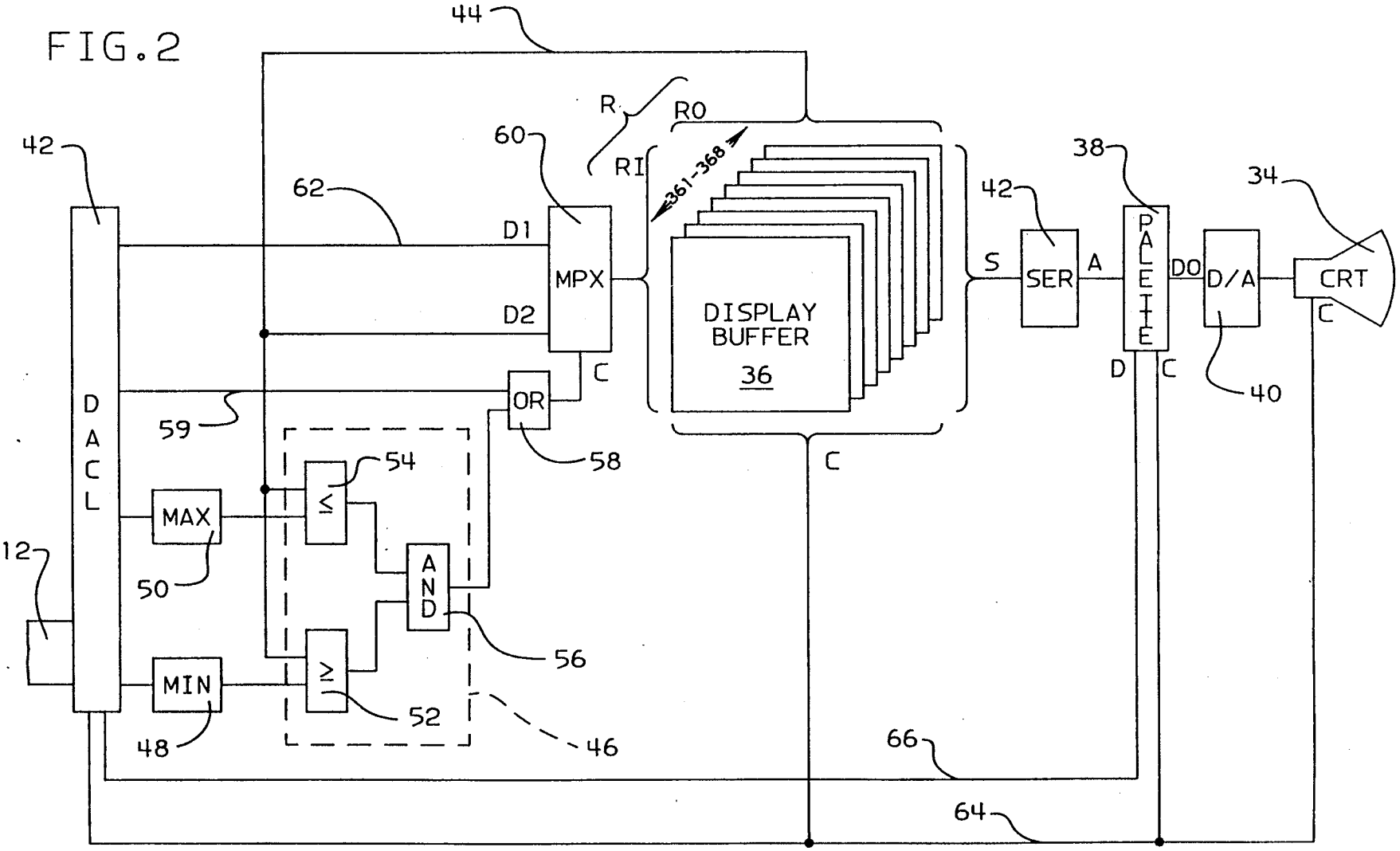
FIG. 2 is a schematic block diagram of part of a display system including a preferred embodiment of the present invention.

As shown in FIG. 2, the range comparator 46 comprises a "greater than or equal to" comparator 52 which compares the value on the connection 44 to a value stored in a minimum register 48, a "less than or equal to" comparator 54 which compares the value on the connection 44 to a value stored in a maximum register 50 and an AND gate 56 for combining the outputs of the first two comparators 52 and 54.

In operation, if a value on the connection 44 lies within the range defined by the maximum and minimum values stored in the maximum and minimum register 50 and 48, the output of each of the comparators 54 and 52 will be true and consequently the output of the AND gate 56 will be true. If the value on the connection 44 lies outside the range defined by the values in the maximum and minimum registers, then the output of one of the comparators 54 and 52 and the output of the AND gate 58 will be false.

The output of the AND gate 56 is connected via an OR gate 58 to the control input C of a multiplexer 60. First and second data inputs D1 and D2 of the multiplexer 60 are connected, respectively, to receive data via a data path 62 for updating the display buffer and data via connection 44 from the display buffer. A logical true value at the control input of the multiplexer 60 causes the data from the data path 62 to be selected at the first data input whereas a logical false value causes the selection of the data from the connection 44 at the second data input of the multiplexer.

A logical true value on a line 59 which forms the second input to the OR gate 58 is used to isolate the range comparator during a first phase of operation to be discussed later by forcing the control input C of the multiplexer 60 to a logical true value.

In a second phase of operation, however, a logical false value on the line 59 enables the output of the range comparator to control the multiplexer. During this second phase, a true value is supplied to the control input of the multiplexer when the value on the connection 44 read out from the display buffer falls within the range specified by the values in the maximum and minimum register 50 and 48 and a logical false value is supplied to the input of the multiplexer when the value on the connection 44 falls outside the range.

The display adapter control logic (DACL) 42 shown in FIG. 2 is responsible for controlling the operation of the display adapter. Among the jobs it performs is controlling the refreshing of the screen of the cathode ray tube. This is achieved in a conventional manner via the control lines 64 and the control inputs C to the display buffer 36, the palette 38, and the CRT display device 34. The DACL is connected to the personal computer bus 12 and is responsive to information on that bus for, among other things, controlling the updating of the display buffer. It is responsive, for example to data provided by windowing logic shown in FIG. 3.

Figure 3:
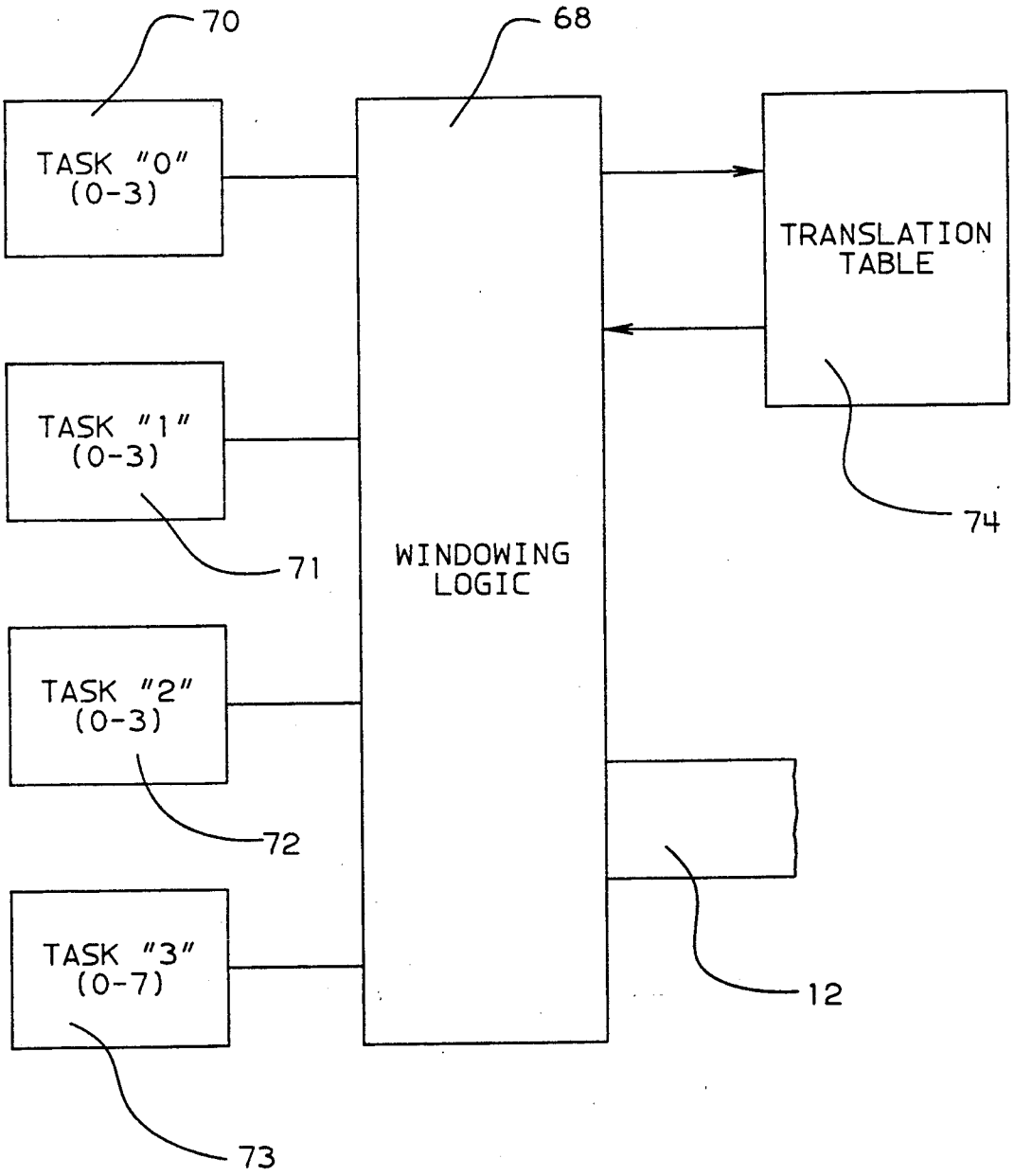
FIG. 3 is a schematic block diagram showing the logical structure of another part of a display system in accordance with the invention.

FIG. 3 is a schematic block diagram showing the logical relationship between the windowing logic 68 and a plurality of tasks 70–73. In this example, the windowing logic forms part of the operating system of the personal computer and is coded in an appropriate manner as will be apparent to the skilled person from the functions of the windowing logic as summarized in the following paragraphs.

The windowing logic 68 is responsible for receiving data for display from each of a plurality of tasks 70, 71, 72 and 73 and communicating this data to the display adapter via the personal computer bus 12. The windowing logic supports the tasks such that individual task think that they are addressing the display buffer directly and that they have sole use thereof. Through the agency of the windowing logic, however, a task addresses a virtual display buffer called a presentation space. Prior art display systems which allow windowing also comprise windowing logic, but the windowing logic 68 in this display system provides unique functions in order to control the operation of the display adapter and the windowing mechanism shown in FIG. 2.

One function provided by the windowing logic 68 is to map the color index values used by individual tasks when writing information to its presentation space, onto values which fit within different ranges of values which are associated with different windows. The numbers at the bottom of the block 70–73 represent color values used by the tasks "0" to "3". In order to do this the windowing logic 68 has access to a translation table 74 which is set up at system initialization time and indicates how the index values for the presentation spaces being supported map onto the ranges of index values used by the windowing mechanism.

Another function of the windowing logic is to put update information for the display buffer onto the personal computer bus when updating the display buffer contents. This involves multiplexing the data streams from respective tasks onto the personal computer bus 12. The windowing logic translates the color values of the tasks using the translation table 74 before placing them on the bus. Each time the source of the update data changes, the windowing logic sends the maximum and minimum values associated with the range of values for the appropriate presentation space to the display buffer and the DACL in the display adapter and causes it to store those values in the maximum and minimum registers, 50 and 48, respectively. After this, the windowing logic then sends data identifying the locations in the display buffer onto which the presentation space is to be mapped, followed by the display buffer update information itself.

The windowing logic 68 is also responsible for updating the palette contents. To update the palette, the windowing mechanism issues data over the personal computer bus 12 identifying the locations in the palette to be updated, followed by a string of data specifying the color information to be inserted at those locations. The DACL is responsive to this data for updating the palette. This technique may be used for setting the palette at system initialization and at subsequent times in order to accommodate additional windows. In this way, the colors defined at each palette location may be freely chosen. It is possible, for example for the same colors to be specified at a plurality of locations. When the windowing logic updates the palette, it will normally be necessary to update the translation table as well, in order to be able to translate the color information from the presentation space for an individual task into appropriate index values within the range of values for the corresponding window. This is also performed by the windowing logic.

The operation of the windowing mechanism in the display adapter will now be described with reference to FIG. 4 and 5. For reasons of ease of illustration, a display field 80 of only 8 by 8 pixels is shown. Normally the display field will be of the order of $10^3$ by $10^3$ pixels. Likewise, for ease of illustration and explanation, only a small palette 38, of 32 locations is shown. As mentioned above, a palette will normally comprise of the order of 256 locations. However, it will be understood that these values are merely illustrative, and in practice the display field and the number of palette entries may be of any appropriate size.

Each time a new window is defined, or the windows on the display are reconfigured, the data in the display buffer is updated under control of the windowing logic 68. If this operation means that a change is necessary to the contents of the palette, then the palette and the translation table will be updated as well as explained above. It will be appreciated that the contents of the palette can be changed independently of that of the translation table and the display buffer contents if it is desired, for example to change the colors, only, on the display screen without changing other aspects of the data displayed. For example, the foreground and the background of a piece of text could be changed in one go by swapping the color values stored in two palette locations.

For the purposes of the following explanation it is assumed that the initial content of the display buffer is not known, as might be the case, for example, at system initialization.

The windowing logic 68 is responsive to input data specifying the number of tasks which each require a window to be specified for their respective presentation spaces (in this case four tasks) and also responsive to input data specifying the colors used by each of the tasks and the order of priority for the windows to be displayed. This input data may be provided in any appropriate way, for example by direct user input.

The windowing logic initiates a first phase in which the initial data is written into the display buffer by issuing a command over the system bus to cause the DACL to put a valid signal on the line 59 to the OR gate to isolate the range comparator. The previous content of the display buffer is not taken into account during this phase as the valid signal output by the OR gate 59 causes the multiplexer 64 to select the data supplied by the windowing logic via the DACL when this is to be written into the display buffer. The display screen will normally not be refreshed during this phase.

Then, the windowing logic issues display buffer addresses to the DACL specifying the outline of each of the windows to be displayed and the index values to be stored at locations within those windows. It is convenient to supply the index values of a window in the order of scanning of the display for refreshing the display screen. This is not a requirement in the present case as the data in the display buffer can be updated in a random access manner. However, it is conventional to update the display buffer in this way. Usually, a display screen is scanned line by line and within each line, pixel by pixel, although any other suitable technique for scanning the display buffer could be used. The DACL, on receipt of the outline and content data, causes the index values to be stored at the indicated locations. This can be performed using an area fill facility of an appropriate type, as will be known to the person skilled in the art and is found in many existing display systems. This facility can be incorporated as part of the functions of the DACL and may require as input parameters, for example, the top left and bottom right coordinates of a rectangular area to be filled. The outline and content data is supplied window by window in ascending order of window priority. In this way, the data for a window of a higher priority can replace the data of a window of lower priority where the pixel positions overlap.

Figure 4:
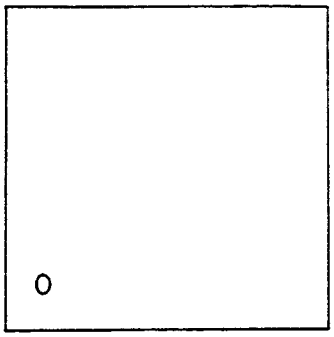
FIGS. 4, 5 and 6 illustrate the operation of aspects of a display system in accordance with the invention.
Figure 4:
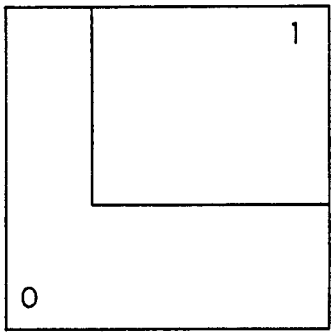
Figure 4:
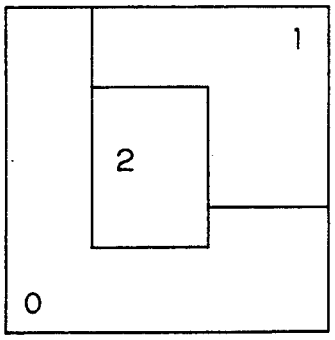
Figure 4:
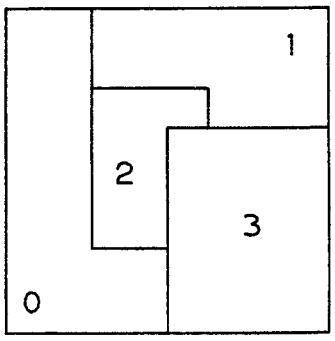
Figures 5, 6:
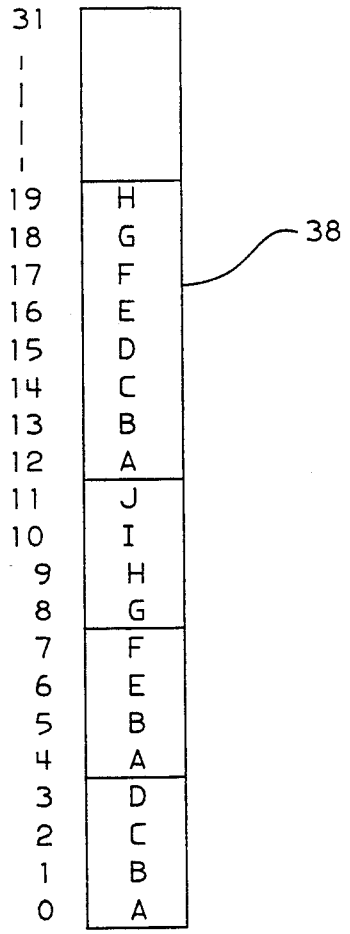

In this example (FIG. 4), the whole display field 80 forms the lowest priority window, here window "0", as shown in FIG. 4B. Window "0" can comprise pixels having four different colors as defined in the palette 38 at locations 0 to 3. In this example, the initial data to be displayed in the window is the background color "A" for this window which is specified by the location 0 in the palette. The windowing logic issues data identifying the outline of the window "0" (e.g. the top left (0,0) and bottom right (7,7) of the rectangular window) followed by a stream of zeros (i.e. the index value for the color "A" for that window). The area fill facility of the DACL determines from the outline for the window, the locations into which the zeros are to be written (i.e. the whole of the display buffer) and writes the zeros into those locations. FIG. 4A shows the content of the display buffer after this range.

Window "1" is the window having the second lowest priority. This window can contain pixels having four different colors as defined in the palette 38 at locations 4 to 7. For this window, the windowing logic issues data identifying the outline of the window "1" (e.g. by means of the top left (2,0) and the bottom right (7,4) corners of the rectangular window) followed by a stream of fives (i.e. the index value for the color "B" for that window). Once again the DACL determines from the outline for the window, the locations into which the fives are to be written and writes them into those locations. In doing so, certain of the zeros stored for the window "0" are overwritten. FIG. 4C shows the content of the display buffer following this stage and FIG. 4D represents the layout of the windows.

Window "2" is the window having the next, higher priority. This window can contain pixels having four different colors as defined in the palette 38 at locations 8 to 11. Once again the windowing logic issues data identifying the display buffer locations of the top left (2,2) and the bottom right (4,5) corners of the rectangular window "2" followed by a stream of index values representing a given color for that window (e.g. a string of nines, for the color "H"). The DACL determines the extent of the window from the corner values and writes the nines into the appropriate locations in the same way as before. In doing so, the values previously stored at those locations are overwritten. FIG. 4E shows the content of the display buffer following this stage and FIG. 4F represents the layout of the windows.

Window "3" is the window having the highest priority. This window can contain pixels having eight different colors as defined in the palette 38 at locations 12 to 19. In the same way as before, in response to data from the windowing logic identifying outline of this window (e.g. by identifying the corners (4,3) and (7,7) and the values to be stored at the locations in the windows (i.e. a string of eighteens for the color "G"), the DACL determines the extent of the window and writes the eighteens into the appropriate locations in the same way as before. Once again, the values previously stored at these locations are overwritten. FIG 4G shows the content of the display buffer following this stage and FIG. 4H represents the visible extent of the windows.

The actual colors which appear on the screen (i.e. the displayed chrominosity and/or luminosity of the pixels) are determined by the content of the palette entries indexed, or addressed, by the index values in the display buffer. FIG. 4 represents the content of the palette, where the letters A, B, C, D, E, F, G, H, I and J each represent different colors. The palette entries are assumed to be divided into five ranges, locations 0–3, 4–7, 8–11, 12–19 and 21–31, one for each of the four windows and one which is unused at present but may be used for additional windows. It will be noted that some colors are specified in more than one range. This is illustrative of the versatility of the present invention. It will be appreciated that the number of windows and the number of colors available within each windows is variable. Normally, many more windows would be supported, in many cases with a larger number of color per windows, the numbers being limited in this simple example for reasons of ease of illustration.

Once the background data for each of the windows has been written into the display buffer 36, the information to be displayed can then be written into the buffer during a second phase. Before being supplied with this information, the windowing logic causes the DACL to remove the logical true from the line 59 and replace it with a logical false. This has the effect of enabling the range comparator to control the multiplexer 60.

The windowing logic is then in a position to put update information for the display buffer onto the personal computer bus when updating the display buffer contents. This involves translating the color values used by the respective tasks using the translation table 74 and multiplexing the data from the presentation spaces associated with those tasks onto the personal computer bus. Each time the source of the update data changes, the windowing logic sends the maximum and minimum values associated with the range of values for the appropriate presentation space to the display buffer and causes the DACL in the display adapter to store those values in the maximum and minimum registers, 50 and 48, respectively.

In the second phase, information defining the mapping of the presentation space onto the display field (e.g. for a rectangular presentation space, the top left and bottom right corners) is supplied to the DACL, followed by the data for updating the display buffer, which are supplied in an ordered manner. Conveniently, as stated before, the update data are supplied line by line, and within each line, pixel by pixel. The DACL 42 addresses the display adapter and causes data previously stored in the display buffer at the locations for which the update data is destined to be read out and supplied on the connection 44. The DACL also causes the update data to be passed over the path 62 to the multiplexer switch 60 in synchronism with the supply of the data from corresponding display buffer locations over the connection 44. Each data value read out of the display buffer 38 is compared to the range defined by the values in the maximum and minimum registers. If the value read out falls within the range, then the range comparator outputs a true value which in turn causes the multiplexer switch to select the data item in its first input D1 for updating the display buffer. In other words, if the value read out falls within the range, then the corresponding item of updated information is written into the appropriate location in the display buffer. If the value read out does not fall within the range, then that pixel position lies outside the window in question and accordingly the range comparator outputs a false value which causes the multiplexer switch to select the data value read out of the display buffer (i.e. the data item at its second input D2) to be rewritten into the display.

For example, say that a screen of data forming a presentation space for the task associated with window "2" contains the information shown in FIG. 6A. By taking each item of update information in turn, examining the content of the location for which that item of update information is destined to see whether the value at that locations falls within the appropriate range of values (i.e. between 8 and 11), and storing only those values where the comparison is positive, only the update information which corresponds to the visible part of the window of the presentation space (i.e. those locations where a "9" is stored in the display buffer in FIG. 5G) will be used to update the display buffer to create modified display buffer contents as illustrated at FIG. 6B.

As the index values to be stored in the display buffer for the task associated with the window "2" are always between 8 and 11, this being assured in the present embodiment through the agency of the windowing logic and the translation table, this update process can be repeated indefinitely. As a second example, say that the screen of data forming a presentation space for the task associated with window "2" is changed to the information shown in FIG. 6C. As for the example illustrated in FIGS. 6A and 6B, the windowing logic supplies the maximum and minimum values for the range (i.e. 11 and 8) and these are stored in the maximum and minimum registers 50 and 48 by the DACL. Following information to define the mapping of the presentation space onto the display field, a stream of update information is then supplied as before. Once again, only the update information which corresponds to the visible part of the window of the presentation space (i.e. in this example, those location where an "8", a "10" or an "11" are stored in the display buffer in FIG. 6B) will be used to update the display buffer to create modified display buffer contents as illustrated at FIG. 6D, as it is only those locations which contain values between 8 and 11.

The other windows are updated in the same way. It should be noted that his occurs without any of the tasks being aware that they do not have exclusive use of the display field. In other words, the window management is transparent to the tasks themselves. Apart from the constraints on the number of colors available at any one time to a task window which results from the partitioning of the palette, there are no constraints on the colors which are available to the tasks. In the example shown in the figures, up to four different colors are available to each of tasks 0, 1 and 2 for display in windows 0, 1 and 2, respectively and up to eight colors are available to task 3 for display in windows 3. Each of these colors may be chosen from the $2^n$ possible ones which may be defined by a palette entry, where n in the number of bits per entry in the palette. Thus, as shown in FIG. 5, some colors may be available in a number of different windows.

Figure 7:
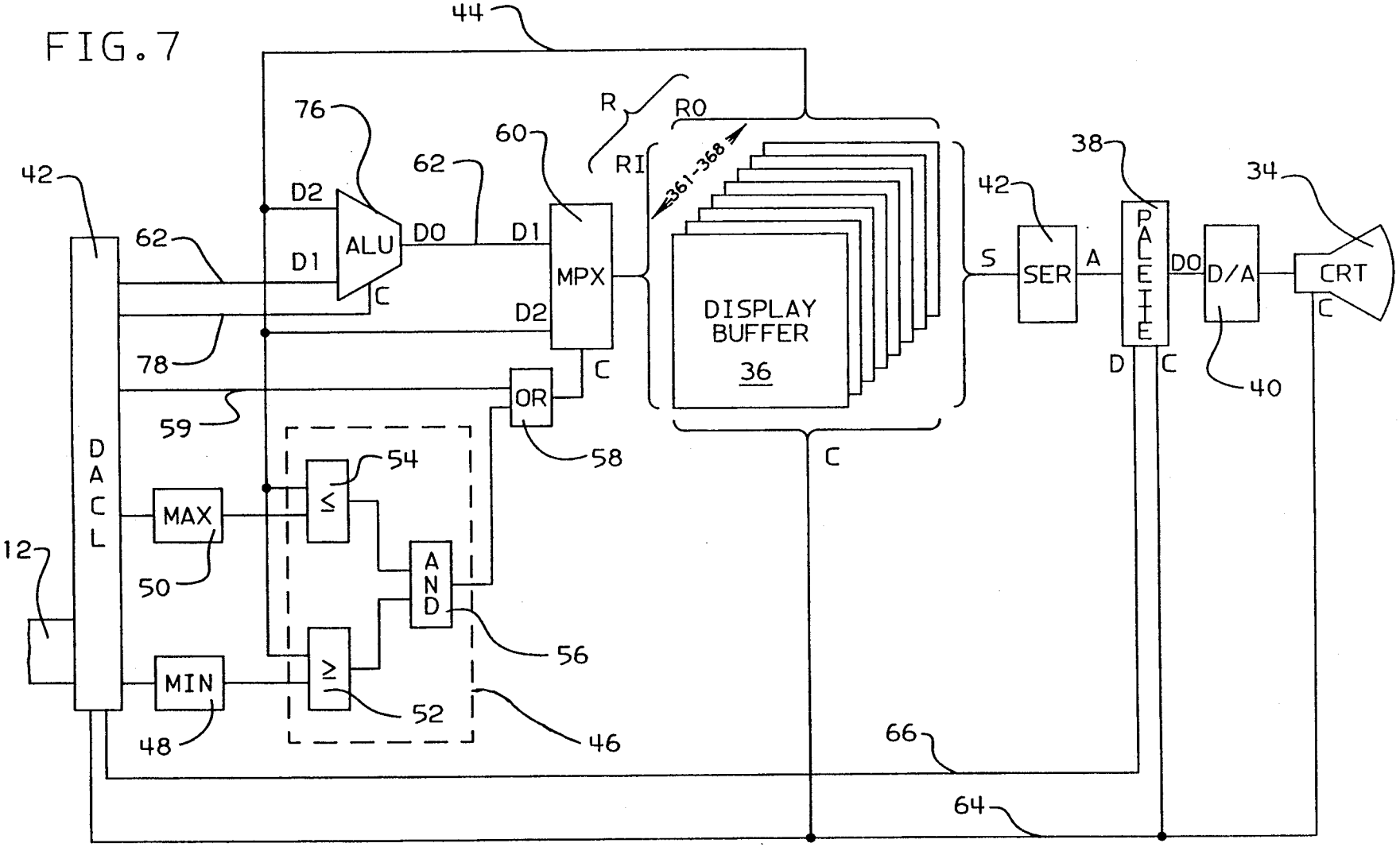
FIG. 7 is a schematic block diagram of an alternate embodiment of the part of the display system shown in FIG. 2.

FIG. 2 shows the update information being supplied directly from the DACL 42 to the multiplexer 60. FIG. 7 shows a variation on the FIG. 2 example in which this data may be modified by performing a desired logical operation on it in combination with the data read out of the corresponding locations in the display buffer. To this end an arithmetic and logic unit (ALU) 76 may be provided in the data path 62, whereby a first data input D1 of the ALU 88 is connected to the first part of the data path 62. The second data input D2 of the ALU 88 is connected to the data connection 44 from the display buffer 36. A control path 78 is provided from the DACL 42 to the ALU 76 for selecting an operation to be performed. The ALU can be of conventional form and allows various logical and arithmetic operations to be performed on the data already displayed on the screen and the update data such as AND, OR, EXCLUSIVE OR, AVERAGE and so on under the control of the DACL and in response to control information from the windowing logic.

A display system in accordance with the invention allows more efficient window processing. In the above embodiment, the initial setting up of the display buffer (i.e. the first phase) is primarily under software control. However, the setting up phase only has to be done very infrequently, at system initialization and when the configuration of the windows in the display field is changed. Normal updating of the display buffer (i.e. in the second phase) is performed by responding to index values stored at individual pixel positions in the display buffer to determine the visible extent of a given window within the display field. In addition, it may not be necessary to completely reinitialize the display buffer when a window is changed on the screen, but may only be necessary to initialize or redraw only certain of the windows.

Although homogeneous data is stored for each window during the first phase in the examples described with reference to FIG. 4, this need not be the case. If the area fill facility is arranged to take streams of data from the appropriate presentation spaces when filling each window are in turn, the actual data to be displayed may be written directly into the display buffer during the first phase instead of, for example, background information. The data written in during the first phase will then be updated further during the second phase as described with reference to FIG. 6.

The performance of the display system in the second phase is independent of the shape of the windows or the parts thereof which remain after the first phase. Thus, if an appropriate area fill facility is provided to allow non-rectangular window shapes to be defined (e.g. circles, triangles, or even more complicated shapes) then the invention allows these to be displayed in an efficient manner. Numerous area fill techniques for filling rectangular and non-rectangular areas are know in the art.

Although a particular embodiment of a display system in accordance with the present invention, and a modification thereto, has been described above, it will be apparent that many modifications and additions are possible within the scope of the present invention.

For example, only one range comparator is shown in FIGS. 2 and 7. This assumes that only one pixel position is read from the display buffer at one time. It would be possible to include a plurality of range comparators and to read out a plurality of pixel positions from the display buffer at one time for processing in parallel. although this would involve duplicating some hardware - there would need to be more lines on the feedback connection 44 for example - the display buffer could be updated more quickly.

Although a dual output display buffer is described, a display buffer with only a single output port may be used. The only effect of this is that the amount of timer per refresh scan, which is available for update processing will be reduced. Also, although it is assumed in the above, that the display buffer could in practice form part of the random access memory of the personal computer and be within the address space of the CPU 10.

Whereas it is preferred that the range comparator shown in FIGS. 2 and 7 is implemented in hardware, it will be appreciated that this could be provided in any appropriate manner, for example by appropriate software. This might be desirable in low cost embodiment with the display buffer in the random address space of the personal computer.

Similarly, although in the particular embodiment described, the color code values of respective presentation space are translated by the windowing logic, this translation would not be necessary if the tasks were constrained in some other way to use color code values within the appropriate ranges of values for the corresponding windows. In this case, the translation table would not be needed. A result of this modification might be, however, that the existence of the windowing facility would not be transparent to the tasks.

The present invention is not limited to an implementation in a personal computer. The display system could, for example, be implemented in a terminal for a host processor, or as a subsystem for the host processor. Alternatively, the display system could be in the form of an add-on card for an existing computer system (e.g. a personal computer).

What is claimed is:

1. A display system comprising a palette for picture chrominance and/or luminance information, a display buffer for pixel information defining the pixels of a display field, the pixel information including index values for indexing the palette to select the chrominance and/or luminance of the pixels, and a windowing mechanism for associating a different range of index values with each of a plurality of windows wherein each window may have a visible extent area in the display buffer, and wherein the windowing mechanism controls display buffer update by determining the visible extent of a given window in the display buffer in response to index values stored at individual pixel positions in the display buffer.

2. A display system as claimed in claim 1 in which the windowing mechanism comprises windowing logic for initializing a window by causing index values from the range of values associated with that window to be stored at all pixel positions for that window in the display buffer.

3. A display system as claimed in claim 2 in which the windowing logic is arranged to initialize a plurality of windows by storing the index values for each window in order of priority, starting with the lowest priority window, such that index values for a higher priority window overwrite index values previously stored in the display buffer for an overlapping part of a lower priority window.

4. A display system as claimed in claim 1 wherein the windowing mechanism comprises a range comparator for comparing index values stored in the display buffer to the range of values associated with a given window to determine the visible extent of that window.

5. A display system as claimed in claim 3 wherein the windowing mechanism comprises a range comparator for comparing index values stored in the display buffer to the range of values associated with a given window to determine the visible extent of that window.

6. A display system as claimed in claim 4 wherein the windowing logic causes the range comparator to determine whether an existing index value, stored at a pixel position in the display buffer for which an item of update information is destined, falls within the range for the given window, and wherein the windowing mechanism additionally comprises means responsive to the output of the range comparator to cause the item of update information to be stored at that pixel position in the display buffer if the comparison is positive and otherwise to cause the existing index value to be stored again in the display buffer at that pixel position.

7. A display system as claimed in claim 4 wherein the range comparator comprises an upper bound comparator for determining whether an index value stored in the display buffer is less than or equal to a maximum index value of the range and lower bound comparator for determining whether than index value is greater than or equal to a minimum value of the range, and logic gate means for combining the output of the upper and lower bound comparators for determining whether that index value is within the range defined by the maximum and minimum values of the range.

8. A display system as claimed in claim 7 additionally comprising a maximum register and a minimum register for the maximum and minimum values, respectively, of the range currently being processed.

9. A display system as claimed in claim 8 wherein windowing logic is arranged to associate presentation spaces for the image data of processing tasks with respective windows.

10. A display system as claimed in claim 4 wherein windowing logic is arranged to associate presentation spaces for the image data of processing tasks with respective windows.

11. A display system as claimed in claim 8 wherein the windowing logic is arranged to translate color code values of image data in each of a plurality of said presentation spaces into appropriate index values within the respective ranges for the windows associated therewith.

12. A display system as claimed in claim 10 wherein the windowing logic is arranged to translate color code values of image data in each of a plurality of said presentation spaces into appropriate index values within the respective ranges for the windows associated therewith.

13. A display system as claimed in claim 11 wherein the windowing logic is arranged to cause the maximum and minimum values associated with a given window to be stored in the maximum and minimum registers and subsequently to pass update information for the presentation space associated with that window for updating the display buffer.

14. A display buffering system comprising a display buffer for pixel information defining the pixels of a display field, a windowing mechanism for associating a different range of pixel values with each of a plurality of windows wherein each window may have a visible extent area in the display buffer, and wherein the windowing mechanism controls display buffer update by determining the visible extent of a given window in the display buffer in response to values stored at individual pixel positions in the display buffer.

15. A display buffering system as claimed in claim 14 additionally comprising a palette for picture chrominance and/or luminance information for translation of pixel values in the display buffer to chrominance and/or luminance in the display field.

16. A display buffering system as claimed in claim 14 wherein the windowing logic is arranged to initialize a plurality of windows in the display buffer by storing values for each window in order of priority, starting with the lowest priority window, such that values for a higher priority window overwrite values previously stored in the display buffer for an overlapping part of a lower priority window.

17. A display buffering system comprising a display buffer for pixel information defining the pixels of a display field, a windowing mechanism for associating a different range of pixel values with each of a plurality of windows wherein each window may have a visible extent area in the display buffer, and display buffer update inhibit means inhibiting the update of pixel information in the display buffer for pixels outside the visible extent of a given window within the display field, the inhibit means responsive to values stored at individual pixel positions in the display buffer.

18. A display buffering system as claimed in claim 17 additionally comprising a palette for picture chrominance and/or luminance information for translation of pixel values in the display buffer to chrominance and/or luminance in the display field.

19. A display buffering system as claimed in claim 17 wherein the display buffer update inhibit means can be overridden by the windowing logic thereby allowing said logic to initialize a plurality of windows in the display buffer by storing values for each window in order of priority, starting with the lowest priority window, such that values for a higher priority window overwrite values previously stored in the display buffer for an overlapping part of a lower priority window.

* * * * *